US008845388B1

(12) United States Patent
Dempsey

(10) Patent No.: US 8,845,388 B1
(45) Date of Patent: Sep. 30, 2014

(54) CLEAVAGE SPACER

(76) Inventor: Darlene S. Dempsey, Reseda, CA (US)

( * ) Notice: Subject to any disclaimer, the term of this patent is extended or adjusted under 35 U.S.C. 154(b) by 62 days.

(21) Appl. No.: 13/486,286

(22) Filed: Jun. 1, 2012

(51) Int. Cl.
*A41C 3/10* (2006.01)
*A41C 3/00* (2006.01)

(52) U.S. Cl.
USPC ..... 450/57; 450/54

(58) Field of Classification Search
USPC ..... 450/3–5, 8–11, 15–17, 20, 21, 235, 26, 450/28, 30, 31, 34, 65, 66, 75–79, 58, 89, 450/54–57, 36–38; 2/109–110, 113, 114, 2/104–106, 67, 102, 463, 73, 69; 602/75, 602/76, 41, 19, 661, 53
See application file for complete search history.

(56) References Cited

U.S. PATENT DOCUMENTS 5,083,555 A * 1/1992 Lewis ..... 602/6
5,158,541 A * 10/1992 McCurley ..... 602/79
5,807,160 A * 9/1998 Wehmeyer ..... 450/57
5,843,008 A * 12/1998 Gerhard ..... 602/5
5,951,366 A * 9/1999 Stevens ..... 450/57
6,095,894 A * 8/2000 Stevens ..... 450/57
6,102,772 A * 8/2000 Fernandez ..... 450/1
6,439,958 B1 * 8/2002 Lorenzo ..... 450/1
7,001,239 B2 * 2/2006 Russell ..... 450/57
7,144,295 B2 * 12/2006 Fisher ..... 450/54
7,300,330 B2 * 11/2007 Estrella Garrido ..... 450/37
7,445,541 B2 * 11/2008 Patterson ..... 450/54
8,047,892 B1 * 11/2011 Dempsey ..... 450/54
8,216,023 B2 * 7/2012 Donnelly et al. ..... 450/89

* cited by examiner

*Primary Examiner* — Gloria Hale
(74) *Attorney, Agent, or Firm* — Heisler & Associates

(57) ABSTRACT

A mass of memory foam or similar elastic material is sized and shaped to fit within a cleavage area to space breasts away from the cleavage area and lift the breasts somewhat. The spacer includes a front surface opposite a rear surface and with a base portion opposite a top portion. The base portion is larger than the top portion. Side portions extend from the base portion to the top portion on opposite sides of the spacer. These side portions act upon the breasts to lift and separate the breasts from each other. A band can optionally be provided girding the spacer. The band can be provided as camouflage or decorations can be placed on the band to decorate the spacer. The bands can be replaceable to switch between appearance options.

16 Claims, 5 Drawing Sheets

CLEAVAGE SPACER

FIELD OF THE INVENTION

The following invention relates to functional accessories for use with a bra or similar undergarment within a cleavage area. More particularly, this invention relates to accessories for use with a bra or similar undergarment which shift a position of breasts supported by the bra or similar undergarment, especially adjacent a cleavage area.

BACKGROUND OF THE INVENTION

Proper breast positioning yields many benefits including enhanced comfort and enhanced appearance. With regard to comfort, it is often desirable that the breasts do not contact each other in a cleavage area, or that if they do contact each other that such contact is minimized or occurs with only limited force exerted therebetween. Furthermore, it is often desirable to have a somewhat absorbent and soft material adjacent inner surfaces of the breasts in a cleavage area to more comfortably support the breasts and potentially absorb any perspiration away from the skin.

With regard to appearance, various different shirts and dresses benefit from a particular breast position and a degree of cleavage. While to some extent, bras of different configurations can adjust breast position to best locate the breasts for coordination with the outer garments, it is often impractical to have a separate bra for each outfit.

Furthermore, often a more desirable appearance in the cleavage area can be created if the breasts avoid contact or minimize contact in a cleavage area. It is also often beneficial to elevate the breasts somewhat for enhanced appearance.

Outer garments provide varying degrees of coverage of a cleavage area. When a cleavage area is somewhat visible, the propensity exists for a greater amount of the cleavage area to be visible than the woman desires, and the potential exists for portions of a bra or other undergarment in the cleavage area to be at least somewhat visible. In such circumstances, a need exists for an accessory which can be placed in the cleavage area to at least provide some degree of concealment of a portion of the cleavage area or concealment of a portion of the bra or other undergarment in the cleavage area. Such an accessory can, in addition to providing a concealment function, present a surface which can have some degree of decoration thereon if desired. In such an instance, both advantageous concealment and enhanced decoration can be facilitated.

SUMMARY OF THE INVENTION

With this invention a cleavage spacer and associated method for spacing breasts in a cleavage area is provided. The cleavage spacer is a mass of elastic material, preferably in the form of a mass of memory foam. In one embodiment four pound memory foam has been found to be effective, with the density of such foam varying depending upon the size of the breasts to be supported and personal preference.

The spacer of memory foam can have a variety of different geometries. These geometries generally include a front surface opposite a back surface which are preferably substantially planar and parallel with each other. The rear surface is placed abutting the skin of the wearer in the cleavage area between and slightly below the breasts. Typically, the bra or other undergarment, and most particularly a band of the bra or other undergarment, provides some support for the foam mass spacer to keep it in place within this cleavage area.

A top portion and base portion are provided on opposite sides of the spacer. The base portion is wider than the top portion. Side portions extend between the front surface and rear surface from the base portion to the top portion. These side portions are closer to each other adjacent the top portion than they are adjacent the base portion. The side portions define surfaces which support inner and lower contours of the breasts adjacent the cleavage area.

The memory foam is compressed somewhat by the breasts pressing against these side portions. The side portions also act on the breasts to move the breasts away from each other, widening the cleavage area, and to some extent lifting the breasts vertically. The spacer can have a variety of different sizes and shapes, with some shapes providing a greater amount of lift by having a wider base portion and some spacers providing a greater amount of cleavage width enhancement by being taller and with a narrower base portion.

The side portions can be planar until compressed by coming into contact with the breasts, or can be concave initially, so that a lesser amount of breast repositioning occurs and a greater amount of surface contact is presented between inner surfaces of the breasts and the spacer. Spacers of different sizes and shapes can be provided as a kit so that the wearer has the opportunity to select a spacer having a particular shape to accommodate bras of different styles or to provide a different amount of cleavage width enhancement or breast lifting.

A decoration is optionally provided upon the spacer in some embodiments of the invention. While this decoration could be placed directly upon the spacer in a permanent fashion, most preferably a removable structure is provided with the decoration thereon. This removable structure is preferably in the form of a band which girds the spacer and has a decoration space on a portion thereof. This decoration space is preferably aligned with the top portion of the spacer so that at least a portion of the top portion of the spacer has the decoration space thereon. In a most preferred form, the band forms a complete circuit which is generally cylindrical but with a lower width which is less than an upper width, so that side edges of the band are closer to each other adjacent the base portion than adjacent the top portion. The band is preferably formed of nylon or other elastic material and sized so that the band stretches to fit over the spacer.

The band can merely act to further camouflage the spacer, such as by having a color which matches skin color for the wearer. In other embodiments, the decoration can be provided to enhance the appearance of the cleavage area, when exposed to some degree. The bands can be provided as separate bands of different styles within a kit which can be removably attached to different sized and shaped spacers. In this way, bands having different decorations can be selected to match the decoration desired by the wearer.

OBJECTS OF THE INVENTION

Accordingly, a primary object of the present invention is to provide a spacer for placement within a cleavage area for repositioning of the breasts.

Another object of the present invention is to provide a cleavage spacer which abuts skin of the wearer in the cleavage area to ameliorate cleavage wrinkles.

Another object of the present invention is to provide a cleavage spacer which is formed of an absorbent material which can to some extent absorb perspiration from skin of the wearer in a cleavage area.

Another object of the present invention is to provide a cleavage spacer which can be used with bras of different configurations to adjust the performance of a bra or related undergarment.

Another object of the present invention is to provide a cleavage spacer which adds a decoration to the cleavage space.

Another object of the present invention is to provide a cleavage spacer which conceals to some extent a portion of the cleavage area and/or a bra or similar undergarment within the cleavage area.

Another object of the present invention is to provide a method for spacing breasts in a cleavage area and otherwise repositioning the breasts.

Another object of the present invention is to provide a method for enhancing modesty of a cleavage area.

Another object of the present invention is to provide a method for adding decoration to a cleavage area.

Other further objects of the present invention will become apparent from a careful reading of the included drawing figures, the claims and detailed description of the invention.

DESCRIPTION OF THE PREFERRED EMBODIMENT

Figure 9:
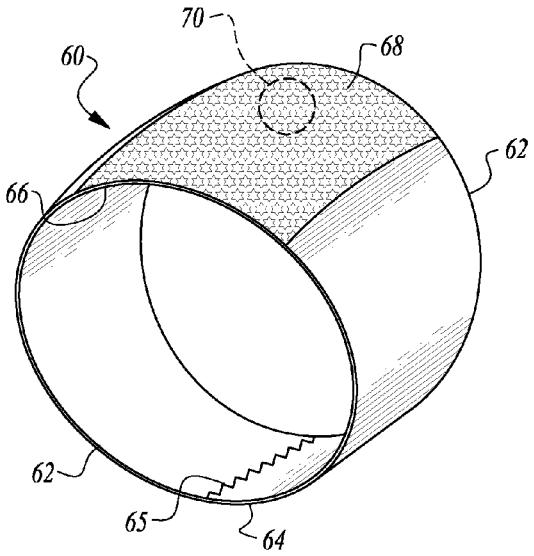
FIG. 9 is a perspective view of a band for attachment to one of the cleavage spacers of this invention, such as to provide decoration to the cleavage spacer.
Figure 10:
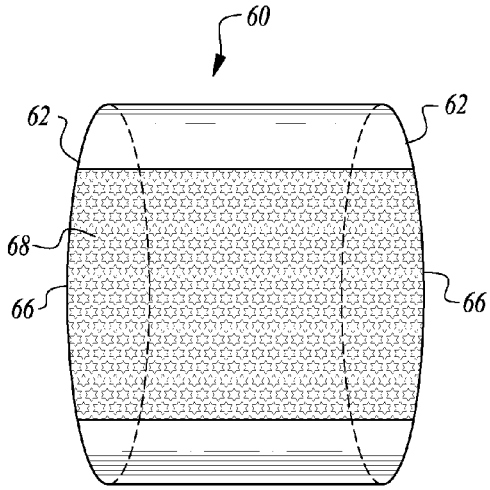
FIG. 10 is a top plan view of that which is shown in FIG. 9.
Figure 11:
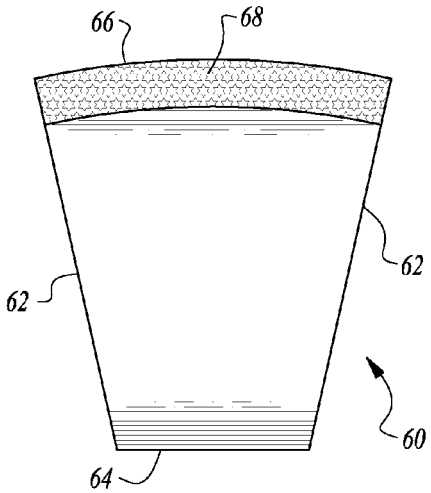
FIG. 11 is a front elevation view of that which is shown in FIG. 9.
Figure 12:
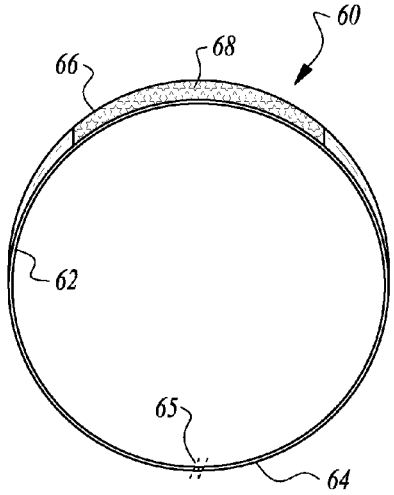
FIG. 12 is a side elevation view of that which is shown in FIG. 9.

Referring to the drawings, wherein like reference numerals represent like parts throughout the various drawing figures, reference numeral 10 is directed to a cleavage spacer (FIGS. 2 and 3) which can be placed within a bra B or related undergarment within a cleavage area C for movement of the breasts (along arrow A of FIG. 2) to enhance a width of the cleavage area C and to lift the breasts somewhat. The cleavage spacer 10 can be fitted with a band 60 (FIGS. 9 and 13) for camouflage or to provide a location where a decoration can be displayed.

In essence, and with particular reference to FIGS. 2, 3, 9 and 13, basic details of the spacer 10 of this invention are described, according to a first embodiment. The spacer 10 is a mass of foam, preferably memory foam sized and shaped to fit above a band D of a bra B between cups F of the bra B and within a lower portion of a cleavage area C between the breasts of the wearer. This spacer 10 includes a front surface 20 opposite a rear surface 25. A base portion 30 defines a lowermost portion of the spacer 10 opposite a top portion 40. Side portions 50 extend from the base portion 30 to the top portion 40 between the surfaces 20, 25. Side portions 50 contact inner and lower portions of the breasts adjacent the cleavage area for enhancing a width of the cleavage area C (by movement of the breasts along arrow A of FIG. 2) and lifting the breasts to some extent. A band 60 (FIG. 9) can optionally be providing girding the spacer 10. This band 60 can include a decoration space 68 thereon if desired.

Figure 2:
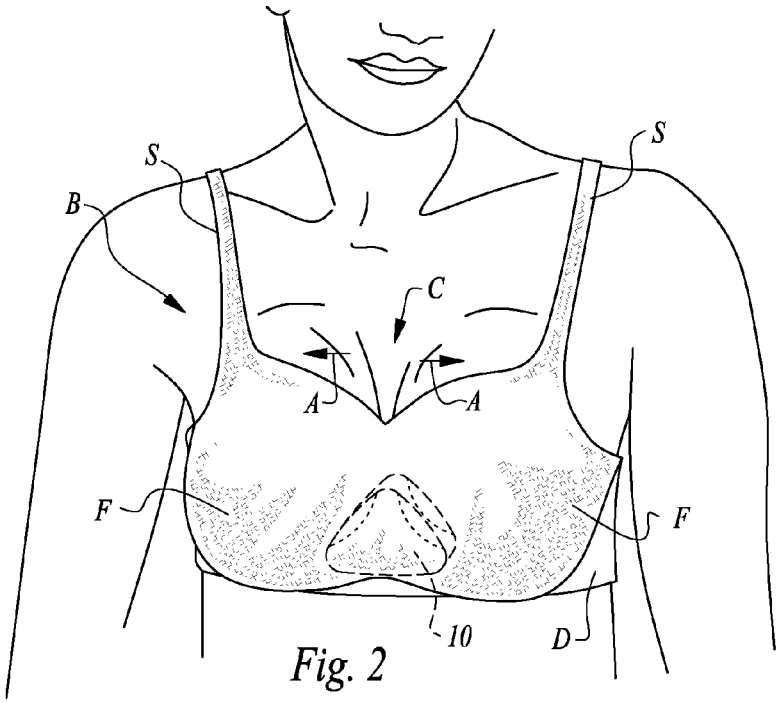
FIG. 2 is a front elevation view similar to that which is shown in FIG. 1 but with a cleavage spacer of this invention shown in broken lines and identifying a typical position where the cleavage spacer is used, according to a method of this invention, to space the breasts further away from each other and to lift the breasts somewhat.
Figure 3:
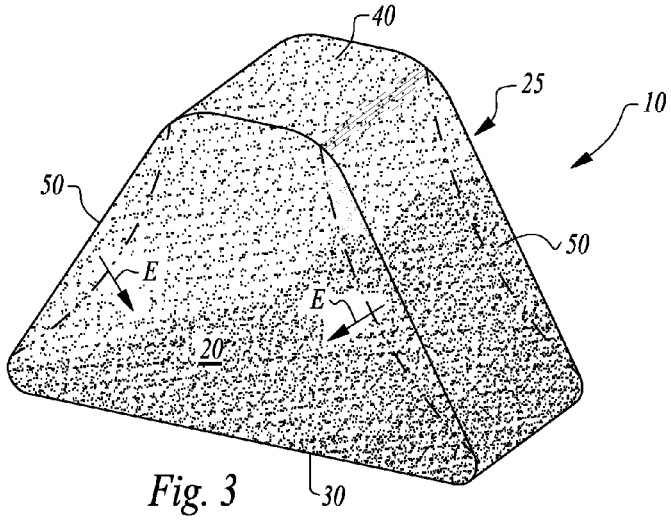
FIG. 3 is a perspective view of a cleavage spacer according to a first embodiment of this invention.
Figure 4:
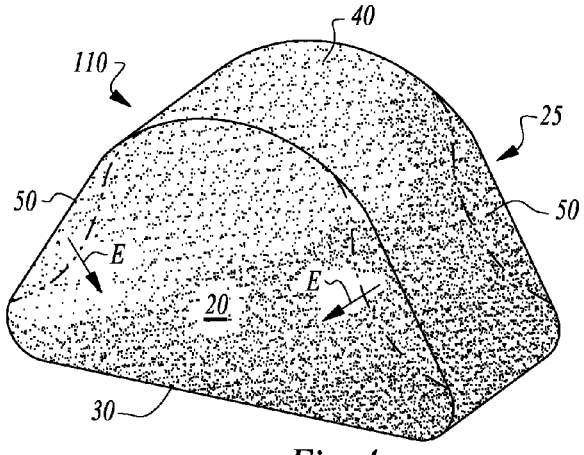
FIGS. 4-8 are perspective views of alternative embodiments of that which is shown in FIG. 3.
Figure 5:
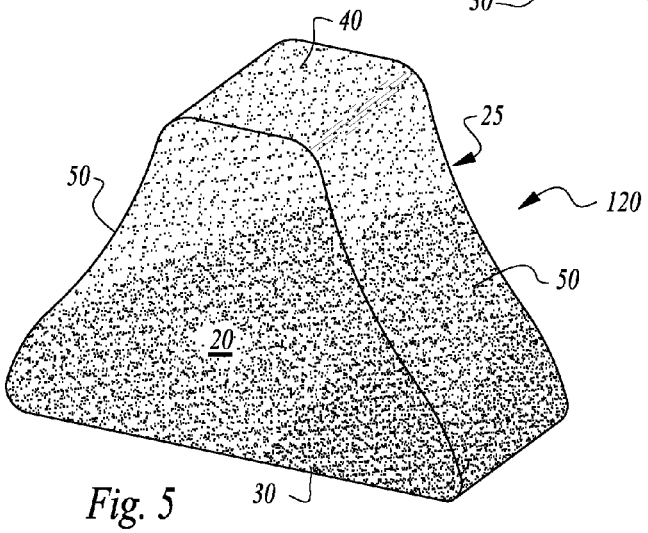
Figure 6:
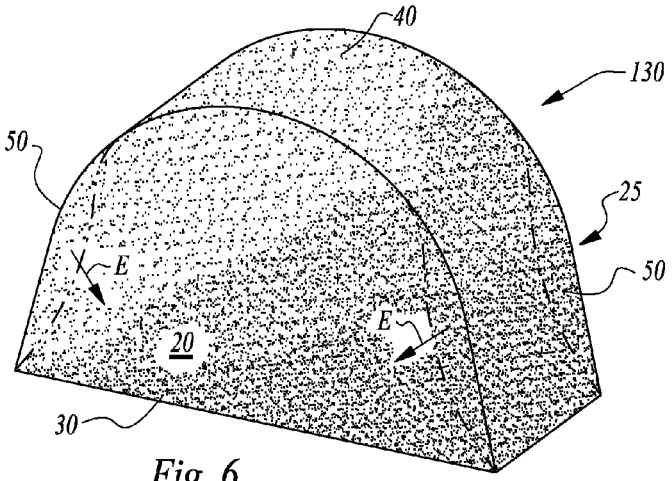
Figure 7:
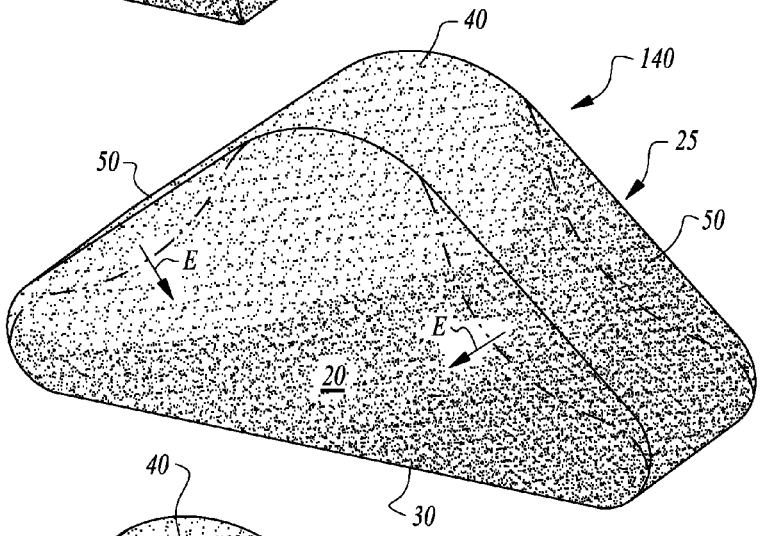
Figure 8:
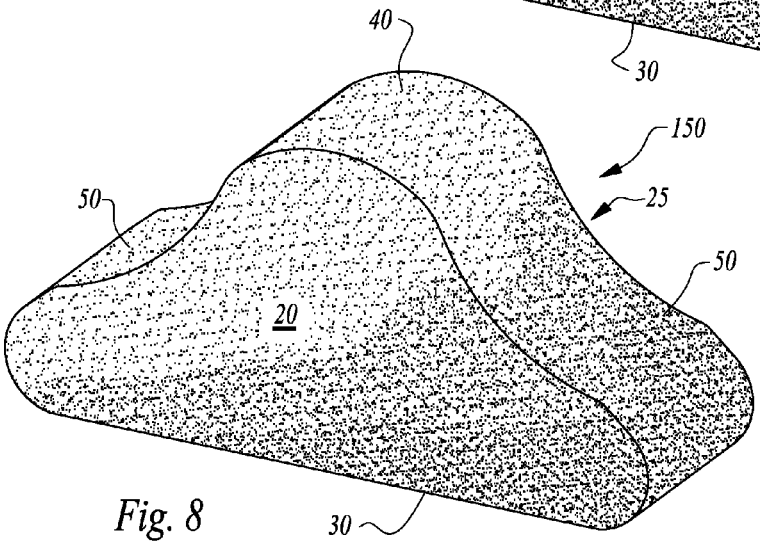

More specifically, and with particular reference to FIG. 3, specific details of the spacer 10 are described, according to a first embodiment. The spacer 10 is a mass of material sized and shaped to fit within a cleavage area C (FIG. 2) of a wearer, typically within a bra B or similar undergarment above a band D of the bra B and between cups F of the bra B. This bra B optionally includes straps S also acting to hold the bra B upon a torso of the wearer and overlying breasts of the wearer.

The spacer 10 is formed of a resilient material which conforms somewhat to the breasts when brought into contact with surfaces of the breasts. A preferred material for the spacer 10 is memory foam. A preferred density of memory foam is four pound memory foam, but with women having larger breasts a higher density memory foam might be selected, or to meet the particular preferences of the wearer, memory foam of greater or lesser density could be selected.

The size of the spacer 10 can vary to fit the geometry of different women and for different particular performance attributes, with general dimensions of approximately four inches wide, three inches tall and one to one and one-half inches deep being exemplary.

Most preferably, the spacer 10 has a constant thickness between a front surface 20 and rear surface 25. These surfaces 20, 25 could be contoured somewhat, but are most preferably planar and parallel with each other. A perimeter of these surfaces 20, 25 is preferably perpendicular to the front surface 20 and rear surface 25, such that a surface area of the front surface 20 is identical to a surface area of the rear surface 25. As an alternative, these surfaces 20, 25 could have differing sizes, but similar (or different) shapes so that a non-perpendicular perimeter surface would extend between the surfaces 20, 25.

Portions of the spacer 10 between the surfaces 20, 25 include the base portion 30, top portion 40 and a pair of side portions 50. The base portion 30 is preferably substantially planar and defines a portion of the spacer 20 to be located adjacent and slightly above a band D of the bra B (FIG. 2). The top portion 40 is opposite the base portion 30 and typically approximately parallel with the base portion 30. The base portion 30 is larger than the top portion 40. This causes the side portions 50 to be non-parallel with each other and closer to each other at the top portion 40 than at the bottom portion 30. Transitions between the base portion 30 and side portions 50, as well as transitions between the side portions 50 and the top portion 40 are preferably gradual with curves provided for these transitions.

By providing the base portion 30 larger than the top portion 40, the side portions 50 apply forces on the breasts, adjacent the cleavage area C, which tend to widen the cleavage area C and also lift the breasts somewhat (along arrow A of FIG. 2).

Figure 1:
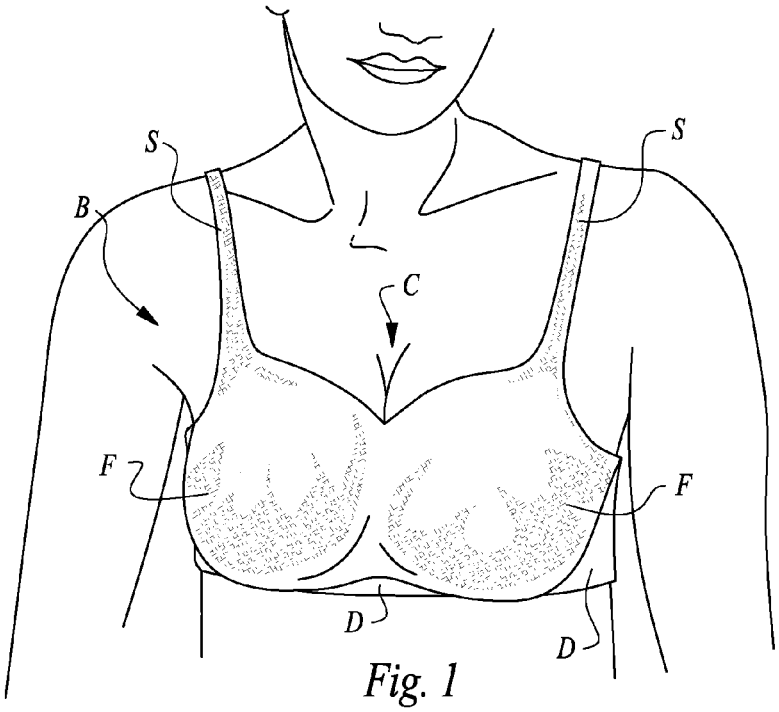
Fig. 1 (Prior Art)
FIG. 1 is a front elevation view of a woman's torso and cleavage area when wearing a bra and without utilization of the cleavage spacer of this invention, according to the prior art.

The side portions 50 are planar in this embodiment until they come into contact with the breasts, after which contact they obtain a somewhat concave form due to the breasts pressing against the side portions 50 somewhat. Such deflection of the side portions 50 is depicted in FIG. 3 by arrow E. A broken line depicts the geometry change experienced by the spacer 10 under such forces applied by the breasts thereto. A reaction force occurs between the spacer 10 and the breasts which tends to move the breasts away from each other and lift the breasts somewhat, thus widening the cleavage area C. Such widening is depicted by comparison of FIGS. 1 and 2.

With particular reference to FIGS. 9-13, details of the band 60 are described which show the band 60 in an exemplary embodiment (FIG. 13) placed upon the spacer 10 of FIG. 3. The band 60 is preferably provided to supply a removably attachable decoration or camouflage for the spacer 10. As an alternative, a decoration could be provided directly on the spacer 10, such as by printing or attachment directly to the top portion 40 of the spacer 10. When the band 60 is utilized, the band 60 would have a decoration space 60 thereon which either provides decoration 70 (FIG. 9) or camouflage for an upper part 66 of the band 60.

The band 60 preferably has a geometry in the form of a cylinder with a hollow interior so that the band 60 forms a circuit of cylindrical form. Side edges 62 are generally circular and define ends of the band 60. These side edges 62 are preferably substantially circular, but not parallel with each other. Rather, the side edges 62 preferably exhibit a taper which causes a width of the lower part 64 of the band 60 to be shorter than a width of the upper part 66 of the band 60. A seam 65 is preferably provided, such as at the lower part 64. Alternatively, the band 60 could be formed as a complete circuit, so that no seam 65 would be required.

The decoration space 68 is located on the upper part 66. When the band 60 is attached to the spacer 10, the lower part 64 is adjacent the base portion 30 and the upper part 66 is adjacent the top portion 40. Thus, the decoration space 68 is presented on the top portion 40. The seam 65 is hidden beneath the base portion 30, if such a seam 65 is provided.

Most preferably, the band 60 is formed of elastic material, such as nylon. Such nylon fabric can be similar to that which is utilized to form sheer pantyhose stockings. The color of this band 60 material can be selected to match skin tones when camouflage is desired. When a contrasting color is desired, other colors for the band 60 can be selected. The decoration space 68 can be omitted or merely provided to be inconspicuous and to perform a camouflage function.

The decoration space 68 can alternatively include a contrasting decorative function. Examples of decorations 70 which can be placed upon this decoration space 68 include jewels, color accents, pictures, icons, precious metals or any other materials known or developed in the future for decoration of clothing.

The particular geometry of the band 60 is depicted in FIGS. 9-12 with the various views shown therein. When the band 60 is placed upon the spacer 10 (FIG. 13) the smaller size of the lower part 64 causes significant portions of the spacer 10 to extend out of the side edges 62 of the band 60. However, the top portion 40 is entirely covered (in this embodiment) by the upper part 66. Bands 60 of different widths or sizes can be selected for decorative or functional purposes. While the band 60 is shown only covering a portion of the spacer 10, the band 60 could entirely encapsulate the spacer 10.

The band 60 is preferably provided smaller than the spacer 10 so that the band 60 must be stretched to fit over the spacer 10 and then exhibits a tight fit over the spacer 10. The band 60 thus has a tendency to soften curves at corners of the spacer 10, such as edges between the surfaces 20, 25 and the side portions 50 of the spacer 10.

Multiple bands 60 of different shapes and sizes, with different decorations can be provided and then selected for attachment to spacers 10 to change an appearance of the spacer 10 if desired. Also, by making the band 60 removable, the potential for washing the spacer 10 separate from the band 60 is presented.

With particular reference to FIGS. 4-8 and 14-16, details of spacers 110, 120, 130, 140, 150 are described which provide alternative embodiments for the spacer 10 of the exemplary embodiment identified above. With these alternative embodiments, different geometries are presented. A curved top spacer 110 (FIG. 4) exhibits a more curved form for the top portion 40 of the curved top spacer 110.

The concave spacer 120 (FIG. 5) has a geometry similar to the spacer 10 (FIG. 3) except that side portions 50 thereof already have a concave shape even before coming into contact with breasts of the wearer. Such an initial concave form provides less force against the breasts and can be potentially more comfortable for less aggressive breast repositioning.

The semi-circular spacer 130 (FIG. 6) has somewhat continuously curving side portions 50 transitioning into a top portion 40.

The broad triangular spacer 140 (FIG. 7) is shown which has a significantly wider base portion 30 than top portion 40. The corollary broad concave spacer 150 (FIG. 8) is depicted which is similar to the broad triangular spacer 140 (FIG. 7) except with the side portions 50 having a concave form.

As a general concept, by providing a spacer which is shorter and wider, the spacer provides a greater degree of lifting of the breasts and a lesser degree of enhancing space between the breasts within a cleavage area C (FIG. 2). To the extent the spacers are taller and narrower, the spacers provide a greater degree of spacing of the breasts away from each other within the cleavage space C (FIGS. 1 and 2), but a lesser degree of lifting of the breasts. Bands 60 of different sizes and shapes could be provided to accommodate these different spacers having different geometries and/or sizes. Preferably, the band 60 is sufficiently elastic that it can fit upon a wide variety of spacers having different particular geometries.

When practicing a method for spacing breasts in a cleavage area C of a user, the cleavage spacer 10 (or an alternative spacer) is used as follows. Typically, initially a wearer selects a bra B or related undergarment to be worn which has generally desirable attributes. The wearer then considers the cleavage area C. If the cleavage area C has a desirable appearance, no spacer would be required. If it is desired that the cleavage area C be wider and/or it is desirable that the breasts be lifted somewhat, a spacer 10 is selected having a geometry which will provide the desired degree of lifting and spacing of the breasts away from each other. Once this spacer 10 has been identified having the desired geometry, it is inserted into the cleavage area C above the band D of the bra B, between and slightly below the breasts.

Figure 13:
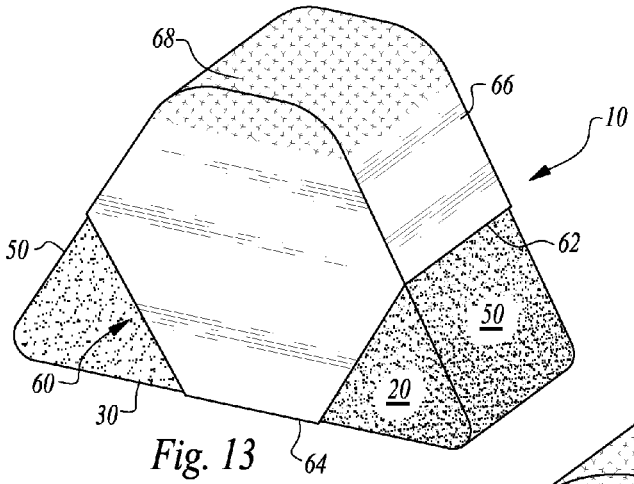
FIG. 13 is a perspective view of the cleavage spacer of FIG. 3 with the band of FIG. 9 located thereon.
Figure 14:
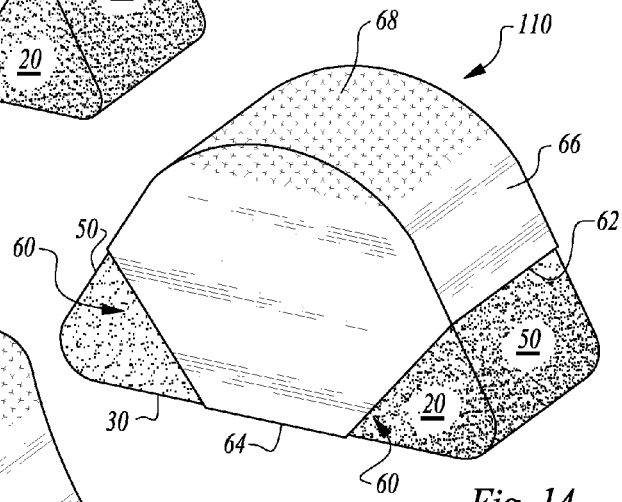
FIG. 14 is a perspective view of the cleavage spacer of FIG. 4 with the band of FIG. 9 located thereon.
Figure 15:
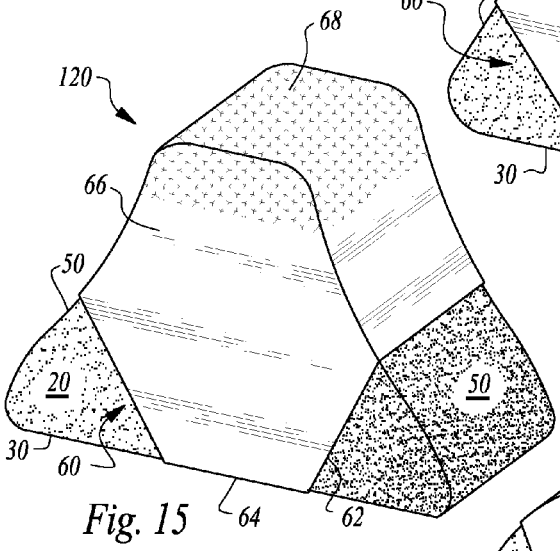
FIG. 15 is a perspective view of the cleavage spacer of FIG. 5 with the band of FIG. 9 located thereon.
Figure 16:
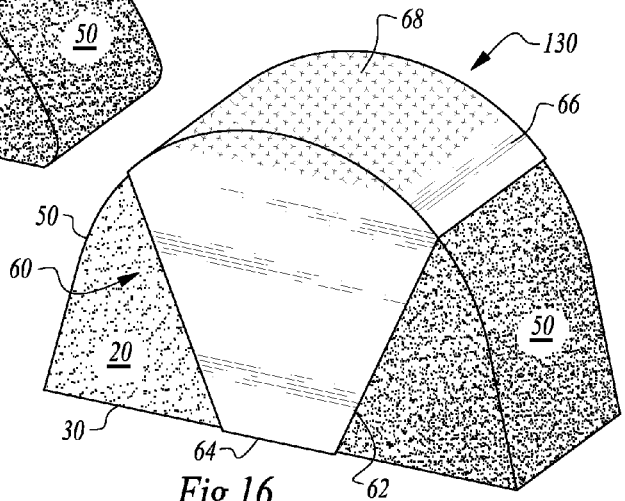
FIG. 16 is a perspective view of the cleavage spacer of FIG. 6 with the band of FIG. 9 located thereon.

If camouflage or decoration is desired for the spacer 10, such as if an outer garment is worn which has the propensity for revealing portions of the cleavage area C, a band 60 is selected which either has appropriate concealment characteristics or a desired decoration for display upon a decoration space thereof. Such a band 60 is selected and then stretched to fit over the spacer 10 until the band 60 girds the spacer 10 with the decoration space 68 presented over the top portion 40 of the spacer 10 (FIG. 13).

The appropriately banded spacer 10 is then placed in the cleavage area C between and slightly below the breasts. Once in place, the breasts are appropriately repositioned (along arrow A of FIG. 2) by action of the spacer 10 upon the breasts. Enhanced support and comfort for the breasts is also to some degree facilitated by utilization of the spacer 10. In addition, the spacer 10 coming into contact with the skin provides an opportunity for absorption of perspiration, prevention of rashes, cleavage wrinkle amelioration, enhanced comfort, support as a post-operative support retainer after plastic surgery, or merely generally to enhance comfort.

This disclosure is provided to reveal a preferred embodiment of the invention and a best mode for practicing the invention. Having thus described the invention in this way, it should be apparent that various different modifications can be made to the preferred embodiment without departing from the scope and spirit of this disclosure. When structures are identified as a means to perform a function, the identification is intended to include all structures which can perform the function specified.

What is claimed is:

1. A method for spacing breasts from a cleavage area of a wearer's chest, the method including the steps of:

donning a bra, the bra including a torso girding band and a pair of cups above the band, the cups at least partially supporting the breasts therein;

identifying a spacer, the spacer formed at least partially of memory foam material;

placing the spacer between the cups and at least partially above the band of the bra with portions of the spacer in contact with each of the breasts;

wherein said identifying a spacer step includes the step of identifying a decoration on at least a portion of the spacer; and wherein said identifying a spacer step includes the spacer having a top portion opposite a base portion and side portions extending from the top portion to the base portion on opposite sides of the spacer, the decoration located on at least part of the top portion of the spacer.

2. The method of claim 1 wherein said identifying a spacer step includes the spacer having a top portion opposite a base portion and side portions extending between said top portion and said base portion on opposite sides of the spacer.

3. The method of claim 2 wherein said identifying step further includes said spacer having the top portion and the base portion substantially parallel with each other.

4. The method of claim 2 wherein said identifying a spacer step includes the spacer having the side portions located closer to each other adjacent the top portion than adjacent the bottom portion.

5. The method of claim 4 including the further step of allowing the side portions of the spacer to be compressed toward each other while also causing breasts adjacent to the side portions to be spaced further from each other.

6. The method of claim 1 wherein said identifying a spacer step includes a band girding the spacer about the top portion and the bottom portion, the decoration located upon the band.

7. The method of claim 6 wherein said identifying a spacer step includes the band formed as a circuit of elastic material sized to require stretching of the elastic material from a relaxed state to gird the spacer, the band overlying at least part of the top portion and the bottom portion of the spacer.

8. The method of claim 7 wherein said identifying a spacer step includes the band having an upper part overlying the top portion with a greater width than a lower part overlying the bottom portion.

9. The method of claim 8 including the further step of modifying the spacer of said identifying step by taking the band, considered a first band, off of the spacer and replacing the first band with a separate second band having a different appearance than the first band.

10. A cleavage spacer, comprising in combination:

a mass of memory foam for placement between the breasts of a wearer overlying the wearer's cleavage area;

said mass of memory foam having a front surface opposite a rear surface;

said mass of memory foam having a base portion opposite a top portion;

said mass of memory foam having a pair of side portions each extending from said base portion to said top portion;

said top portion sized smaller than said base portion;

said side portions located closer to each other adjacent said top portion than adjacent said base portion;

wherein at least a portion of said spacer includes a decoration thereon; and wherein said spacer includes a removably attachable band girding said spacer and overlying at least part of said top portion, said band forming a circuit surrounding said mass of memory foam, said band formed of an at least partially elastic material.

11. The spacer of claim 10 wherein said front surface and said rear surface are each substantially planar and oriented substantially parallel with each other.

12. The spacer of claim 11 wherein said side portions are oriented perpendicular to said front surface and said rear surface and said top portion and said base portion are oriented substantially perpendicular to said front surface and said rear surface.

13. The spacer of claim 11 wherein said front surface and said rear surface are substantially triangular along a majority of a perimeter thereof, with said side surfaces configured to be substantially flat when no forces are applied thereto.

14. The spacer of claim 11 wherein said front surface and said rear surface are generally triangular with said side surfaces configured to be at least partially concave.

15. The spacer of claim 10 wherein said decoration is located on an upper part of the band overlying said top portion of said mass of memory foam.

16. The spacer of claim 15 wherein said band has a generally cylindrical shape with said upper part having a width greater than a width of a lower part and with a decoration space located upon said upper part, and with side edges which taper from said upper part to said lower part with said side edges closer to each other and adjacent said lower part than adjacent said upper part.

* * * * *